United States Patent [19]

Winters

[11] Patent Number: 5,015,033

[45] Date of Patent: May 14, 1991

[54] UNDERSEAT RECEPTACLE FOR PURSES AND OTHER POSSESSIONS

[76] Inventor: Deana Winters, 2015 Ahlin Dr., La Canada, Calif. 91011

[21] Appl. No.: 453,766

[22] Filed: Dec. 20, 1989

[51] Int. Cl.[5] ..... A47C 7/62

[52] U.S. Cl. ..... 297/192; 297/188

[58] Field of Search ..... 297/191, 192; 5/308; 224/42.46 B, 275

[56] References Cited

U.S. PATENT DOCUMENTS

| | | | |
|---|---|---|---|
| 397,044 | 1/1889 | Wiecking | 297/192 |
| 960,360 | 6/1910 | Lynch . | |
| 1,297,431 | 3/1919 | Andrew . | |
| 1,900,847 | 11/1930 | Siday . | |
| 2,163,759 | 6/1939 | McCann . | |
| 2,375,819 | 5/1945 | Reid . | |
| 2,707,988 | 5/1955 | Shaub et al. | 224/275 X |
| 2,973,807 | 3/1961 | Close . | |
| 3,160,438 | 12/1964 | Davis | 297/192 |
| 3,180,680 | 4/1965 | Landvik | 297/192 |
| 3,333,890 | 8/1967 | Whitwam | 297/191 |
| 3,584,915 | 6/1971 | Meyers | 297/192 |
| 4,556,250 | 12/1985 | Chapman et al. | 297/192 |
| 4,607,881 | 8/1986 | Merrick | 297/192 |
| 4,624,502 | 11/1986 | Boole | 297/192 |

FOREIGN PATENT DOCUMENTS

| | | | |
|---|---|---|---|
| 1171746 | 1/1959 | France | 297/192 |

*Primary Examiner*—Peter R. Brown
*Attorney, Agent, or Firm*—J. Bartholomew

[57] ABSTRACT

A receptacle for articles is provided for attachment by screws, clamps, rivets, or the like, to the underside of any chair having space available beneath its seat. In one preferred form, the receptacle is comprised of a fabric sheet having an elastic border along at least one of its edges. The fabric sheet, shaped to match the configuration of the seat underside, is inconspicuously mounted thereto such that said sheet is substantially flush with the seat underside. In use, access to the receptacle is gained by pulling down the elastic border, which preferably is provided by stitching a hem along one or more edges of the fabric and disposing an elastic cord therein. When the seat underside includes projecting nails, staples or the like, which may injure one reaching into the receptacle, an underseat cover is employed as a protective shield between the receptacle and the seat. In another preferred embodiment, the underseat receptacle is constructed of a rigid material, such as molded plastic, configured as a relatively concave storage shelf having apertured flanges along its top edge. The flanges are bolted or riveted to the underside of a chair. In both embodiments, the underseat receptacle can be attached beneath a seat such that only one occupying the seat will have access to articles stored within the receptacle.

1 Claim, 3 Drawing Sheets

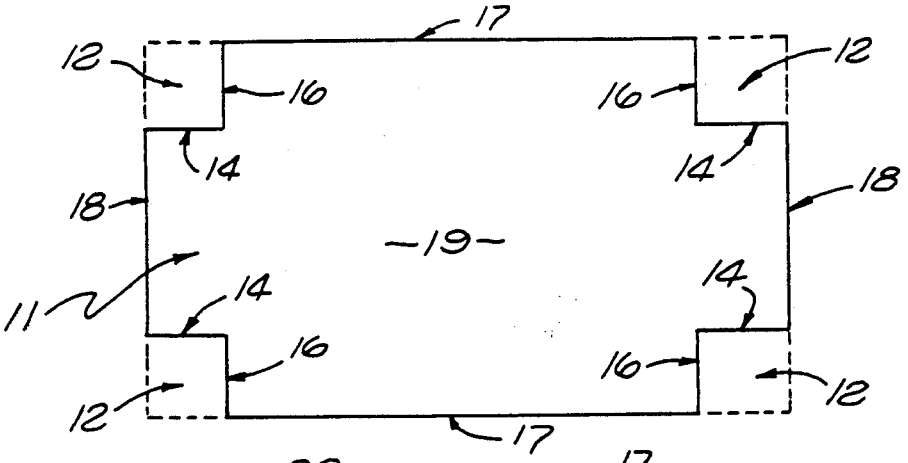
FIG. 3
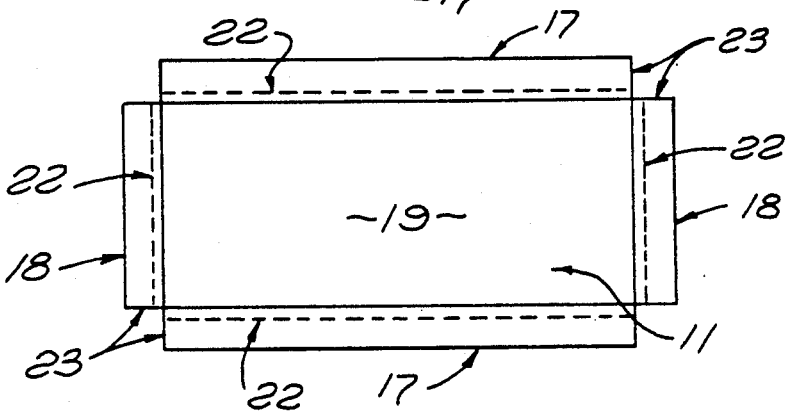
FIG. 4
FIG. 5
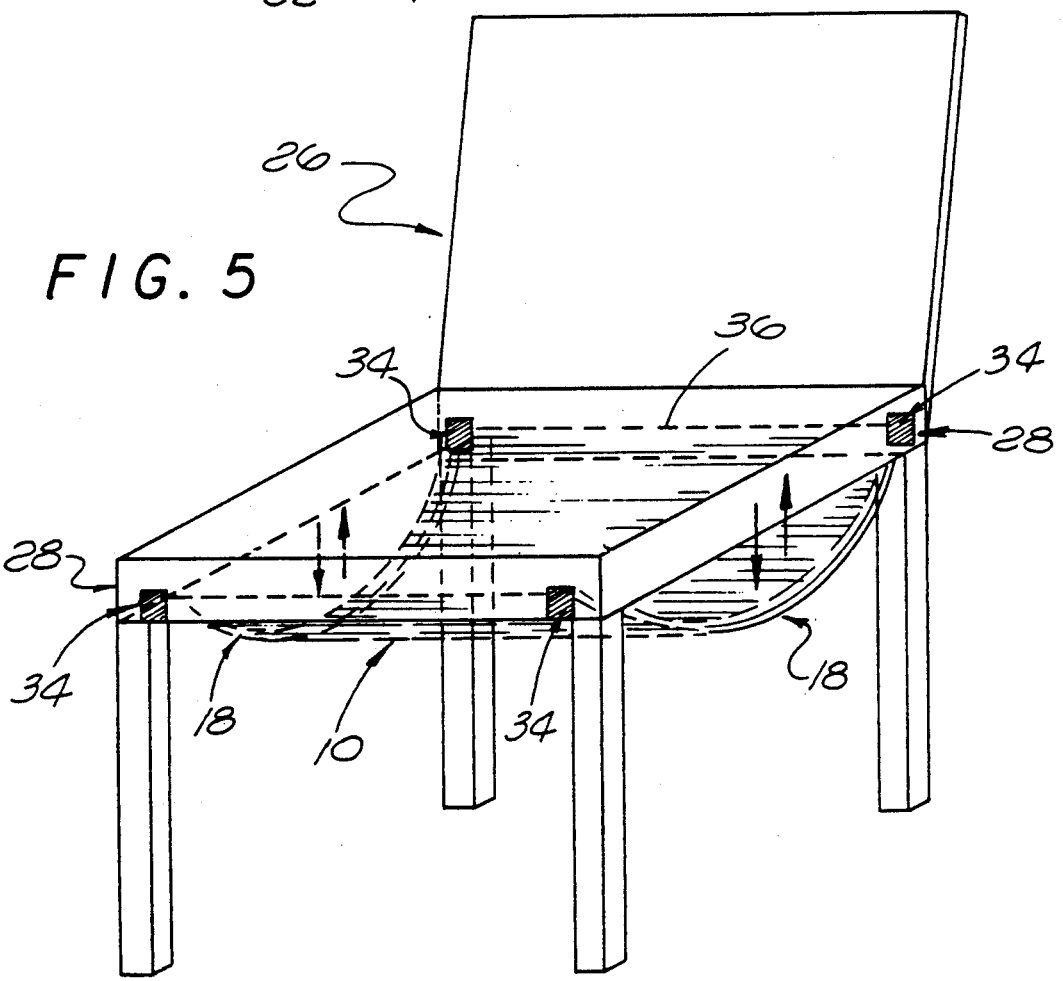

UNDERSEAT RECEPTACLE FOR PURSES AND OTHER POSSESSIONS

BACKGROUND OF THE INVENTION

This invention relates to a receptacle for purses and other articles. More particularly, this invention relates to an improved receptacle for personal possessions which is adapted to fit inconspicuously under seats of chairs in restaurants, theatres and other public assembly areas.

In general, most public facilities do not provide adequate storage space for the personal belongings of those visiting such facilities. For purposes of example, consider the dilemma that women with purses encounter when they visit restaurants or banquet halls. Usually, a secure storage space for their purse is not readily available. Often, a lady may be seated at a table which is too crowded with plates, etc. to permit placement of her purse thereon. Even when space permits it, setting one 's purse on a dinner table is a less than ideal storage solution because such a practice may be considered impolite or may result in the purse getting soiled by spilt food. Storage of the purse on the floor is also undesirable because the purse may get stepped upon, kicked, stolen or soiled. Moreover, retrieval of the purse from the floor can be awkward and difficult for people with physical disabilities. The common practice of storing a purse in one 's lap also leaves much to be desired because maintenance of the purse 's resting spot restricts body movement and quickly becomes uncomfortable. Further, the slope of the lap and/or body movements will eventually cause the purse to slide off one 's lap and onto the floor. Thus, the problem of storing purses (specified throughout for illustrative purposes only) and other personal belongings is present in most general assembly areas.

In the past, a variety of devices which provide a storage receptacle in association with a seat or chair have been invented to address this problem. Exemplary of such devices are the receptacles shown in U.S. Pat. Nos. 960,360; 1,297,431; 2,163,759; and 3,584,915. However, prior receptacles associated with a chair, or the like, generally present one or more of a number of drawbacks. For example, some prior receptacles comprising metal framework attached to a chair, as in U.S. Pat. Nos. 2,973,807 and 3,160,438, may inhibit a compact stacking or folding of chairs, a practice which is commonly done when a public establishment is closed and cleaned. Other prior receptacles for use with a chair are mechanically more complex, as for example in U.S. Pat. Nos. 1,900,847 and 4,624,502, and thus, as with prior devices extensively comprised of metal, are undesirably expensive to manufacture.

Several examples of receptacles for under a seat can be found amongst the prior art, however, a drawback in the design of many such receptacles is that the receptacle either protrudes from the chair to which it is mounted, thereby creating a hazardous obstruction, or the receptacle is highly visible, thereby detracting from the appearance of the chair while also presenting the contents of the receptacle as a temptation for thievery. Some prior devices for holding personal possessions disadvantageously cannot be easily retrofit to already existing chairs. Other prior receptacle devices lack means to prevent accidental displacement of personal possessions from the holder. Yet another problem in the prior art is that many receptacle designs are compatible only with a certain type of chair, thereby limiting their widespread use.

There exists, therefore, a significant need for a receptacle for personal possessions that can be inconspicuously retrofitted to practically any chair in a manner which will not prevent stacking or folding of the chair. Additionally, an improved article holder is needed that will not project beyond the chair structure in an obstructing fashion and that provides a relatively theft-proof storage space which is accessible only to the chair occupant. Ideally, such an improved receptacle should naturally assume a closed position which prevents stored articles from falling out. The present invention fulfills these needs in a simple, inexpensive fashion and provides further related advantages.

SUMMARY OF THE INVENTION

The present invention resides in an underseat receptacle for storing personal articles beneath furniture and, in particular, beneath the underside of a seat or chair, while avoiding the noted drawbacks of prior storage devices. The underseat receptacle generally comprises a flexible sheet of material mounted substantially flush against an underside surface of a seat, table, desk, or the like, with elastic means provided along at least one edge of said sheet so that an elastic border is provided which can be pulled downwardly from said underside surface, thereby creating an opening between said sheet and the seat through which articles can be introduced into or removed from the receptacle.

The underseat receptacle of the present invention advantageously is inexpensive to manufacture, lightweight, simple in construction, and convenient to use. Moreover, the receptacle can be mounted beneath a chair, or the like, in a manner that will not prevent compact stacking or folding of a chair associated therewith. Further, the present invention can be retrofit in a relatively easy fashion onto most any chair, or the like, in an inconspicuous manner that hides stored contents within the receptacle and does not detract from the overall appearance of a piece of furniture associated therewith. Further still, the construction of the receptacle and its mounting arrangement to a chair, or the like, ensure that only an occupant of the chair has access to the receptacle and contents stored therein.

In one preferred embodiment of the invention, a flexible, preferably fabric, piece of material is provided with a hem along or adjacent to at least a portion of the perimeter of the material. An elastic cord, or the like, is provided within the hem so that, once mounted beneath a chair, or the like, the material can be stretched from a position generally flush with the chair underside to an open position whereby access can be gained to a storage volume cooperatively defined by the material and the chair underside. The hem and the elastic cord disposed therein can extend around the entire perimeter of the material if desired.

In another preferred embodiment of the invention, a trapezoidal shaped piece of flexible material is provided with a hem along the longer of the two parallel edges of the trapezoidal piece and an elastic cord is secured within this hem. An optional underseat cover is provided as a protective barrier between the receptacle and the underside surface of a chair, or the like, so that one reaching into the receptacle will not snag any sharp edges projecting beneath the chair. This cover is compatible with each of the receptacle embodiments described herein.

In yet another preferred embodiment of the invention, a rigid, shelf-like receptacle is provided with upwardly extending walls having flanged portions projecting outwardly and relatively perpendicularly from top edges of said walls. In this embodiment, molded plastic is the preferred material of choice. In each embodiment of the invention, the underseat receptacle is mounted, preferably beneath a seat or chair, in a manner which prohibits unwelcome access to contents within the receptacle, so that potential thievery of personal effects is thwarted.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 3 is a top plan view of the flexible sheet of FIG. 1, illustrating a first step of constructing the receptacle, wherein four corner portions of the sheet are cut out from the sheet;

FIG. 4 is a top plan view of the flexible sheet of FIG. 3, illustrating a second step of constructing the receptacle, wherein a hem is stitched (as indicated by dashed lines) around the perimeter of the sheet;

FIG. 5 is a perspective view similar to FIG. 2, showing the receptacle attached to the underside of a seat such that the receptacle is opened along the sides of the seat rather than in the front as shown in FIG. 2;

DETAILED DESCRIPTION OF THE PREFERRED EMBODIMENT

Figure 1:
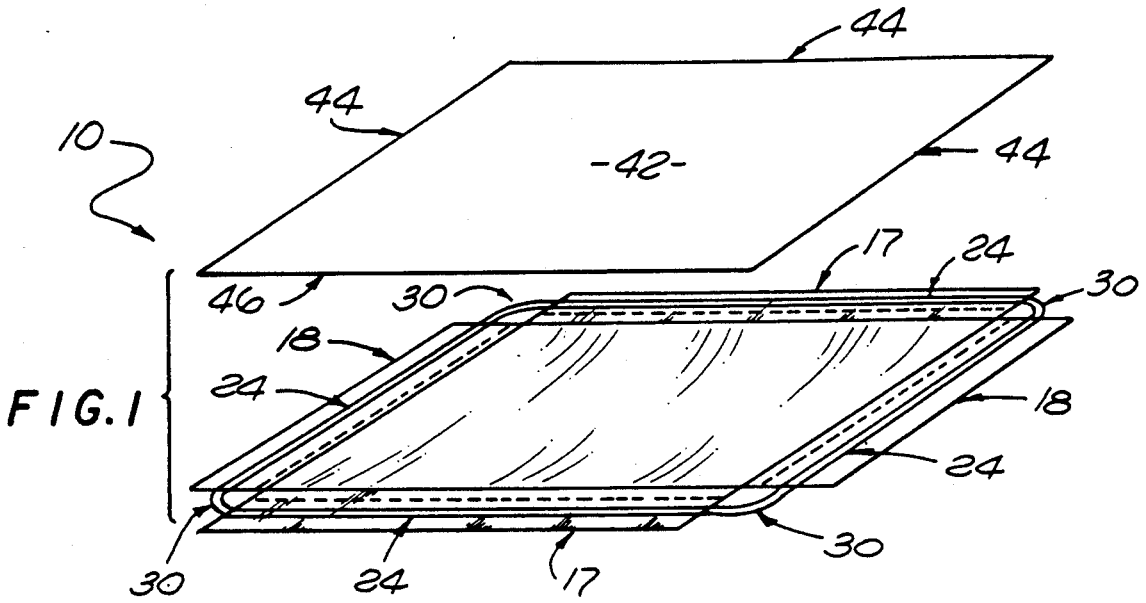
FIG. 1 is a perspective view of an underseat receptacle embodying the invention, showing a lower flexible sheet having an elastic cord around its perimeter, said sheet comprising the portion of the receptacle which supports stored articles, and also illustrating an upper underseat cover which, when attached to the underside of a seat, will shield one from any nails, or the like, projecting therefrom.
Figure 2:
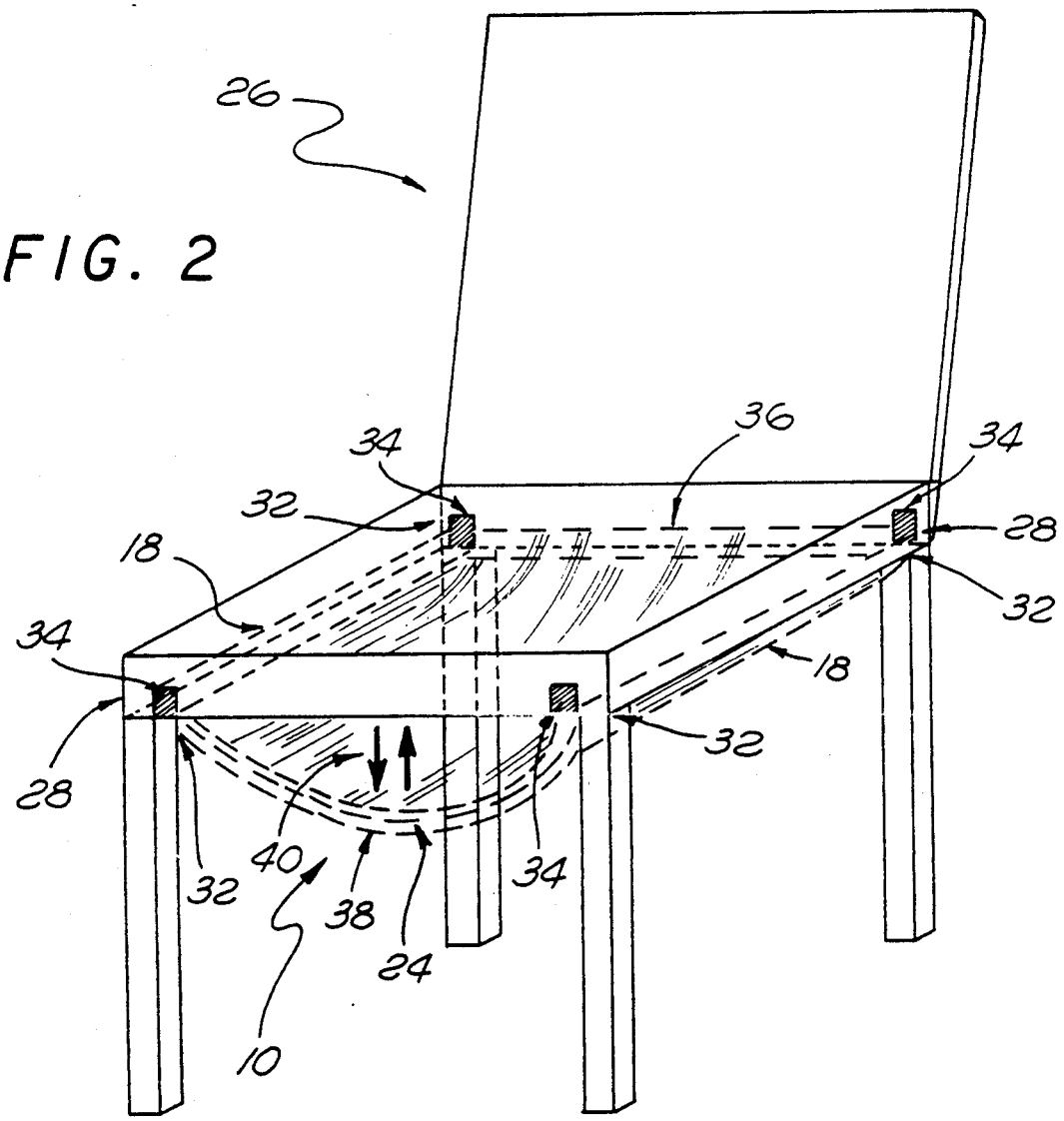
FIG. 2 is a perspective view showing the receptacle attached to the underside of a seat, with the receptacle illustrated in an open position.

As shown in the drawings for purposes of illustration, the present invention resides in an underseat receptacle 10 that provides secure, convenient storage space beneath the seat of a chair when mounted thereto as illustrated in FIGS. 2 and 5. The receptacle 10 features, in one preferred embodiment, a simple, inexpensively manufactured design comprising a durable fabric body having elastic means along at least one side. FIG. 1 depicts this embodiment prior to its installation beneath a seat.

The underseat receptacle of the present invention advantageously fits substantially flush beneath the seat of any chair, so that the receptacle does not interfere with stacking or folding of the chair to which it is mounted. In one preferred embodiment, the elastic means ensure that the receptacle automatically snaps shut after being opened, thereby preventing its contents from accidentally spilling out. The present invention beneficially can be relatively easily retrofit to most chairs in an inconspicuous manner so that contents of the receptacle are not readily visible to would-be thieves. As further protection against theft, the present invention can advantageously be embodied such that articles stored therein are only accessible to a person occupying the chair. Further advantages of the present invention include its light weight, convenience of use, inexpensiveness, and the fact that, once installed, the invention will not create a hazardous obstruction because the receptacle does not project beyond the chair structure.

In accordance with one preferred embodiment of the present invention, the receptacle 10 (FIG. 1) is constructed of a flexible fabric material, such as canvas, nylon, netting, elasticized fabric, impregnated or laminated fabric, etc. However, any suitable character of flexible material may be used instead of fibrous materials. It may be preferred to utilize a solid fabric rather than open work netting in order to ensure that articles stored in the finished receptacle are out of sight. Another of the many advantages of the underseat receptacle of the present invention is that it unobtrusively mounts substantially flush against the underside of a seat, and supports its contents in close proximity thereto, so as not to detract from the overall appearance of an associated chair.

It is further suggested that the color, pattern, etc. of the material comprising the receptacle could be matched with the fashion of any fabric prominent on the chair with which the receptacle is to be employed. It should be understood that, as well as cushioned furniture, the present invention is compatible with conventional metal folding chairs, stackable chairs, wooden chairs, theatre seats, etc.

The embodiment of the receptacle 10 which is seen in FIG. 1, is constructed in the following manner. FIGS. 3 and 4 illustrate the construction. A rectangular piece of material 11, sized in accordance with the seat size of a selected chair, has a relatively rectangular portion 12 (indicated by dashed lines) cut out at each of its four corners. The depth of the cuts along lines 14 and 16 should be such that sides 17 and 18 extend as flaps from a central portion 19 of the material 11, with sufficient material comprising each flap to enable each side 17 and 18 to be doubled back upon itself and hemmed in a manner creating elongated loops of fabric around the perimeter of the material 11. As can be seen in FIG. 4, the material 11 is folded over on all sides 17 and 18 and is sewn along lines of stitching 22, thereby creating a hem 23 around the perimeter of the material 11. An elastic cord 24 (see FIG. 1) is inserted through the hem 23 along all sides 17 and 18 of the material 11 and then the two ends of the cord 24 are joined to each other with a suitable securing means. The length of the cord 24 should be slightly shorter than the perimeter of the material 11 so that the cord must be stretched slightly in order to extend entirely about the perimeter of the material. The elastic memory of the cord 24 causes the cord to return to its normal, unstretched length, thereby contracting the material around its perimeter in a manner which causes the material to gather together. The gathered material should be distributed somewhat evenly along the two sides 17 of the receptacle 10 as shown in FIG. 1.

With reference now to FIG. 2, the receptacle 10 is then attached to the underside of a chair 26, or to the inside edge or bottom edge of the seat frame 28. The elastic cord 24 has portions 30 (see FIG. 1) which are exposed at the four corners of the receptacle 10. These cord portions 30 are secured to the four corners 32 of the chair 26, or to the inside or underside of the seat frame 28. FIG. 2 shows the receptacle 10 attached to the inside of the seat frame 28 by attaching means 34 which can be clamps, staples, velcro, magnetic means, etc. Similarly, a back edge 36 of the receptacle 10 is attached along the rear of the seat frame 28 in one or more places to discourage unauthorized access to the receptacle.

Access to the receptacle 10 is gained by pulling a front edge 38 of the receptacle 10 downward. Arrows 40 show the manner in which the elasticity of the cord 24 and the excess material bunched together by the gathering effect described above, allows one to stretch the front edge 38 downwardly to an open position. Gaining access to the receptacle 10 from its sides 18 is virtually impossible since the material on these sides is not gathered, and therefore has no give to allow expansion of the cord 24.

The receptacle 10 shown in FIG. 1 may also be attached to the chair 26 in several other different ways. For example, the unattached edge of the receptacle which is pulled down to gain access to the interior of the receptacle (i.e., edge 38 in FIG. 2) can face either side or the rear of the chair 26. FIG. 5 shows a receptacle 10 which is open along its sides 18 and is attached to the chair 26 along its back edge 36 and its front edge 38. The arrows in FIG. 5 indicate the manner in which the elasticity of the cord 24 enables each side 18 to be pulled down to an open position. As with the frontal opening version shown in FIG. 2, once a pulled down side portion of the receptacle 10 is released, the elastic cord 24 causes any open edges to snap back to a closed position, whereat the entire receptacle is substantially flush with the underside of the seat frame 28 and its seat.

As an alternative method of construction of the receptacle shown in FIG. 2, the step of cutting out corner portions 12 from the material 11 (as shown in FIG. 3) may be omitted. In this case, a continuous hem is constructed and a small opening is left for the insertion of the elastic cord 24. Alternatively, the cord 24 can be introduced into the hem during the construction of the hem.

The embodiment of the invention described above is preferred for use with seats that have a smooth underside. However, sometimes the underside of the seat is rough and has hazards such as sharp edges, protruding nails or staples that may cause discomfort or injury to a person reaching into the receptacle. For seats with a possible hazard, an underseat cover 42, as shown in FIG. 1, is used with the receptacle 10. The underseat cover 42 creates a protective separation between the receptacle and the underside of the seat. This underseat cover 42 is approximately the size of the receptacle 10 or the size of the seat portion of the chair 26. The material used for the underseat cover 42 can be the same material as the receptacle 10. Since this underseat cover 42 need not be flexed to open or close the receptacle 10, a more rigid type of material, such as a thin sheet of plastic, may be used.

The underseat cover 42 can be attached to the chair 26 or seat frame 28 in one of the following ways:

(a) The underseat cover 42 can be made part of the receptacle 10 by attaching three sides 44 of the cover 42 to the top of the receptacle 10 on both sides 18 and along one side 17. The attaching means can be stitching, gluing or other suitable means. The receptacle 10 is then attached to the underside of the chair 26 or seat frame 28. After this attachment, a fourth side 46 of the underseat cover 42 is secured to the front underside of the seat frame 28 (or to the underside of the seat itself) with a suitable attaching means such as glue, tacks, staples, etc;

(b) The three sides 44 of the underseat cover 42 can alternatively be attached to the underside of the seat frame 28 or its seat at the same time the receptacle 10 is attached to same. The fourth side 46 of the underseat cover 42 is then attached to the front underside of the seat frame 28 or its seat with a suitable attaching means; or (c) First, all sides 44 and 46 of the underseat cover 42 are attached to the undersides of the seat frame 28 or its seat with a suitable attaching means. Next, the receptacle 10 is attached along its sides 18 and its back edge 36 to corresponding underside portions of the seat frame 28 or its seat with suitable attaching means.

Figure 6:
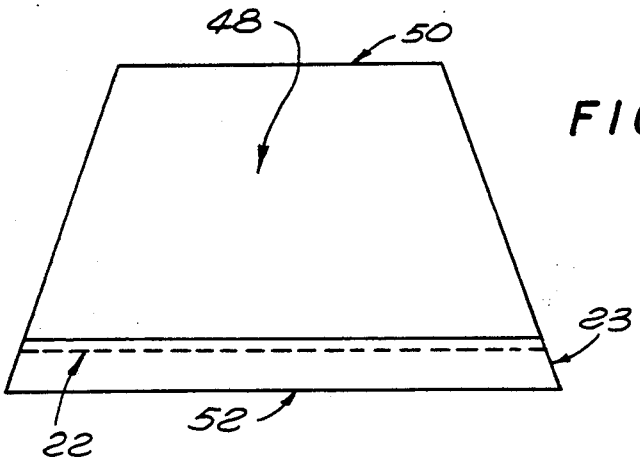
FIG. 6 is a top plan view of a trapezoidal flexible sheet, illustrating a first step of constructing a second embodiment of the receptacle, wherein a hem is stitched (as indicated by a dashed line) along the wider of the two parallel edges of the trapezoidal sheet.
Figure 7:
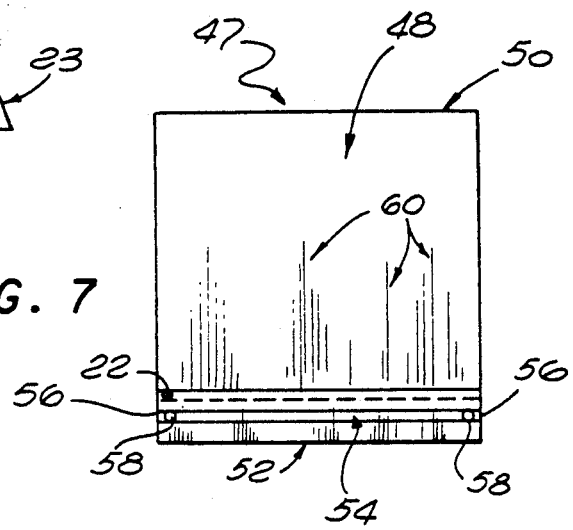
FIG. 7 is a top plan view of the second embodiment of the receptacle, illustrating a completed second step of constructing the receptacle, wherein an elastic cord is inserted into the hem and is secured to the sheet at each of its two ends, thereby causing the trapezoidal shaped sheet to become gathered together into a substantially rectangular configuration.

In another preferred embodiment of the invention, illustrated in FIGS. 6 and 7, a receptacle 47 is constructed of a trapezoidal shaped, flexible piece of material 48 (FIG. 6). The material 48, which is preferably fabric, has a back edge 50 which is approximately the size of a selected seat. The material 48 has a front edge 52 which is longer than the back edge 50 to provide sufficient material to allow gathering of the material along edge 52. The distance between the front and back edges 50 and 52 is approximately equal to the size of the seat plus an amount of surplus material which is sufficient to allow a hem 23 to be created along the front edge 52. The hem 23 is constructed with fastening means such as a line of stitching 22. As shown in FIG. 7, a piece of elastic cord 54 that is approximately the width of the seat is introduced into the hem 23. Both ends 56 of the cord 54 are secured to the ends of the hem 23 with a suitable attaching means 58 such as stitching, rivets, etc. Since the cord 54 is shorter than the hem 23, the material 48 gathers as indicated by wavy lines 60. Alternatively, the hem 23 may be omitted and the cord 54 may be directly attached to the material 48 along its front edge 52.

The method of attaching this finished receptacle 47 to the underside of a seat or seat frame is the same as for the previously described embodiment of FIG. 1. As before, the receptacle 47 can be attached so that the opening of the receptacle faces the front, back or either side of a chair. The receptacle 47 may also be used in combination with a protective underseat cover 42 as described above and shown in FIG. 1.

Figure 8:
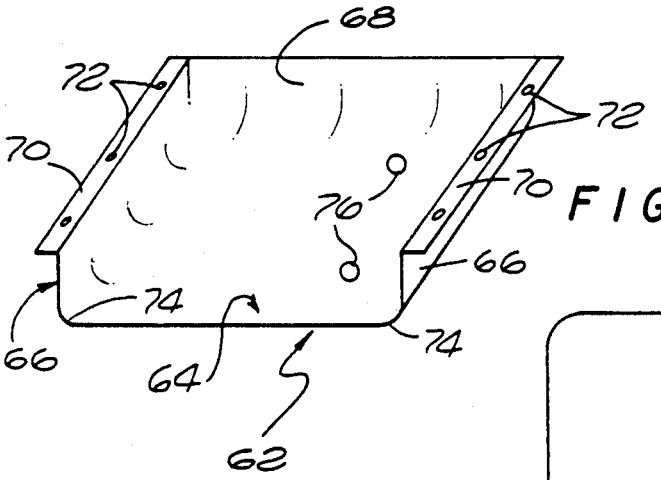
FIG. 8 is a perspective view of a third embodiment of the receptacle, showing a flanged shelf comprised of a rigid material.
Figure 9:
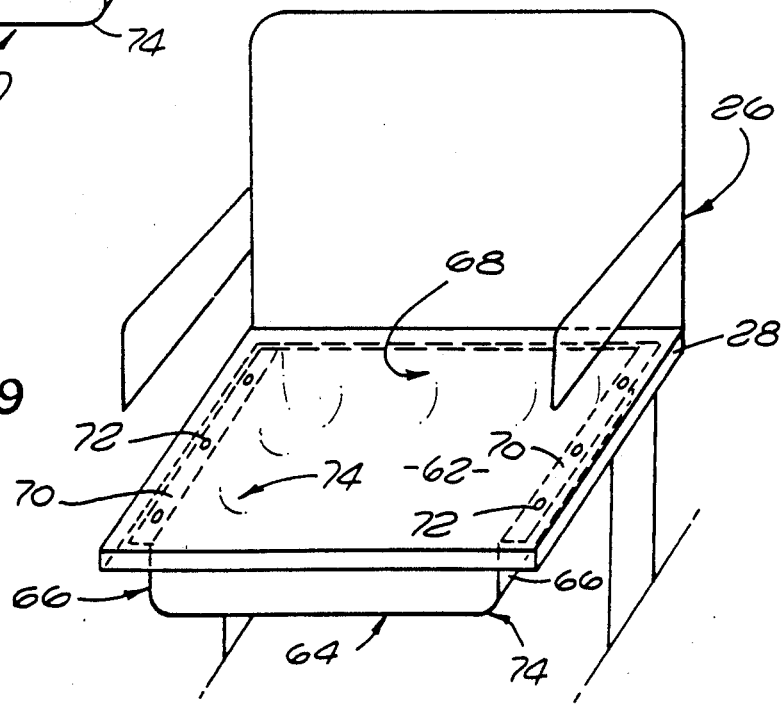
FIG. 9 is a perspective view illustrating the receptacle of FIG. 8 mounted beneath a seat.

In yet another preferred embodiment of the invention, a receptacle 62, as shown in FIG. 8, is constructed of a rigid material, such as molded plastic. In this embodiment, the receptacle 62 consists of a bottom section 64 which functions as a shelf, two side sections 66 and a back section 68. The top of each of the two side sections 66 includes a lip or flange 70 extending outwardly and relatively perpendicularly therefrom. Each lip or flange 70 has two or more holes 72 for attaching means, such as screws or rivets. FIG. 9 illustrates the rigid receptacle 62 attached to the underside of a chair 26. It should be noted that the side sections 66 and the back section 68 include curved lower portions 74 that merge with the bottom shelf section 64 such that no right angle corners are formed where the side and back sections meet the bottom section. This provision enables the rigid receptacle to be more easily cleaned because there are no corners to entrap dirt. When the rigid receptacle 62 is used outdoors, for example with stadium seats, it may be desirable to clean the receptacle using a hose. For this reason, one or more drainage openings 76 can be provided in the bottom section 64 to allow water to escape from the receptacle. Alternatively, the rigid receptacle 62 can comprise a lattice work having a plurality of openings for drainage.

From the foregoing, it will be appreciated that the underseat receptacle of the present invention provides a secure storage space for personal belongings that protects stored items from getting soiled, stepped upon or otherwise damaged. Advantageously, the present invention is simply and inexpensively constructed, is easily attachable to any seat having space thereunder, and is conveniently accessed by a chair occupant while preventing others from having similar access. Thus, the present invention provides a safer (in terms of theft) storage arrangement than the common practice of setting personal belongings on the floor or table of a public assembly area. Moreover, the fabric embodiment of the present invention fits substantially flush against the underside of a chair so that it advantageously does not interfere with the stacking or folding of the chair. This overcomes a drawback found in the prior art.

While several particular forms of the invention have been illustrated and described, it will also be apparent that various modifications can be made without departing from the spirit and scope of the invention. As examples, the receptacle could be constructed in a circular shape in order to be compatible with round seats or chairs. Moreover, the receptacle could be attached beneath a desktop or table rather than a seat. Accordingly, it is not intended that the invention be limited, except as by the appended claims.

I claim:

1. An article holder for attachment to a piece of furniture having an accessible underside surface with empty space proximate thereto, such as a chair, or the like, said holder comprising:

a piece of flexible material having a perimeter and having an elastic cord, or the like, (disposed along at least a portion of its) which extends around the entire perimeter of said flexible material, wherein said elastic cord has opposite ends joined to form a continuous length which is slightly shorter than the perimeter of the piece of flexible material such that the elastic memory of the cord contracts said cord about the perimeter of the material, thereby causing the material to gather together; and means for attaching the material to a selected piece of furniture, wherein said attaching means are disposed about the perimeter of the piece of material such that (said) at least a portion of the perimeter associated with said cord is downwardly pullable away from said underside surface, thereby creating between said underside surface and the material, an opening through which articles are introduced into and removed from the holder.

* * * * *